United States Patent [19]

Miró

[11] 4,282,956

[45] Aug. 11, 1981

[54] RACKING MECHANISM FOR BOBBIN MACHINE

[75] Inventor: Juan C. Miró, Santa Maria de Barbara, Spain

[73] Assignee: Industria Española de Manufacturas Especiales, S.A. (IEMESA), Sabadell, Spain

[21] Appl. No.: 51,211

[22] Filed: Jun. 22, 1979

Related U.S. Application Data

[63] Continuation-in-part of Ser. No. 869,033, Jan. 6, 1978, Pat. No. 4,232,769.

[30] Foreign Application Priority Data

| | | | |
|---|---|---|---|
| Jan. 8, 1977 | [ES] | Spain | 454.896 |
| Jun. 29, 1978 | [ES] | Spain | 471.249 |
| May 18, 1979 | [ES] | Spain | 480.682 |

[51] Int. Cl.[3] ..... F16D 67/00; F16H 57/10

[52] U.S. Cl. ..... 192/4 R; 74/777

[58] Field of Search ..... 192/4 R; 74/777

[56] References Cited

U.S. PATENT DOCUMENTS

| | | | |
|---|---|---|---|
| 838,655 | 12/1906 | Sharp | 74/777 |
| 1,963,308 | 6/1934 | Molinelli | 74/777 X |
| 3,371,556 | 3/1968 | Duchesne | 74/777 |
| 3,664,771 | 5/1972 | Seidlitz | 192/4 R |
| 4,002,088 | 1/1977 | Alsch | 74/777 |

FOREIGN PATENT DOCUMENTS

| | | | |
|---|---|---|---|
| 381759 | 6/1932 | United Kingdom | 74/177 |

*Primary Examiner*—H. Hampton Hunter

*Attorney, Agent, or Firm*—Michael J. Striker

[57] ABSTRACT

The bobbin racking mechanism for a Jacquard machine comprises two stationary shafts arranged side-by-side on a fixed support. One shaft supports for free rotation a drive unit including a drive spur gear which supports on one face an input bevel gear pinion and on the other face an eccentric cam; a transmission unit including a tubular housing having a cross-like section to define four stop arms; two bevel gear pinions are arranged in the tubular housing for rotation about an axis transverse to the stationary shaft, the pinions being in mesh with the input gear pinion; an output unit having an output bevel gear pinion in mesh with the transmission gear pinions, a disc cam having two diametrically opposed recesses and an upper plate with arcuate recesses for racking the bobbins. The other stationary shaft supports an operator member including a sleeve with a pallet fork, a locking device assembled of two superposed coupling plates, the lower plate being linked by a connecting rod to the eccentric cam in the drive unit and continuously performs an oscillating movement and the upper plate is connected to the sleeve. The pallet fork has two radially directed arms forming an angle with one another. One arm is engageable with the recesses in the cam disc in the output unit whereas the lower arm is engageable with the stop recesses in the cross-like housing. A coupling device includes a pivotable ratchet arranged in one of the plates and actuated by means of electrical or mechanical driving mechanism to engage the lower plate with the upper plate when actuated.

15 Claims, 30 Drawing Figures

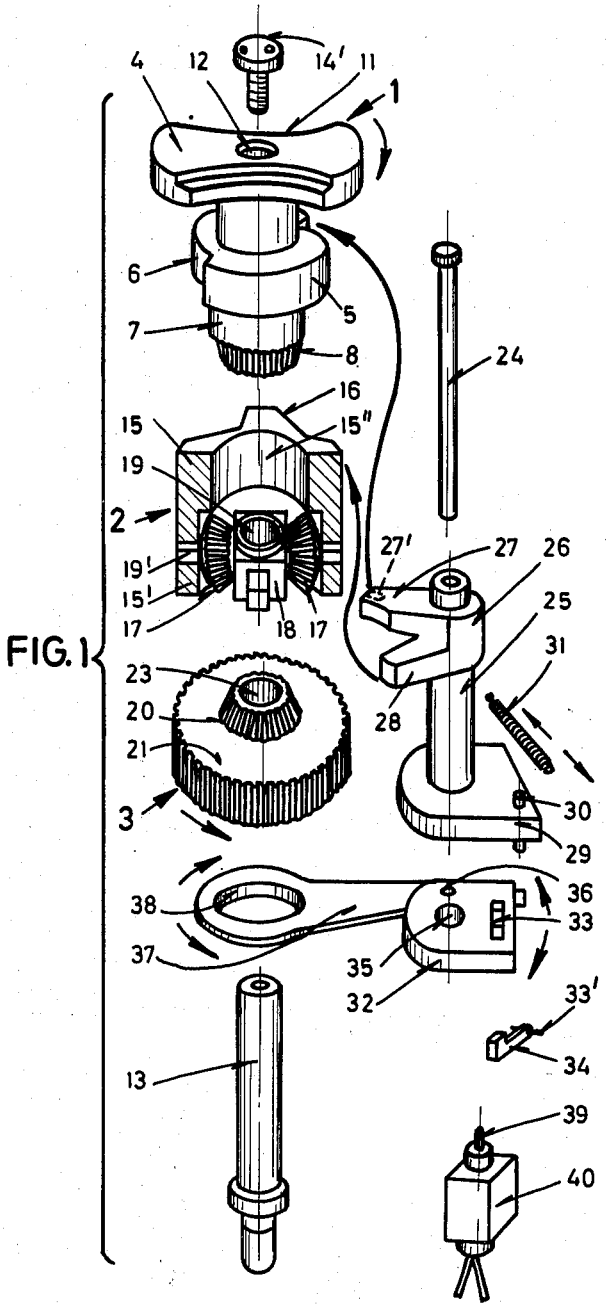
FIG. 2
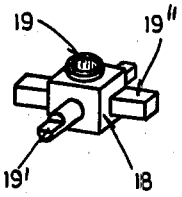
FIG. 3
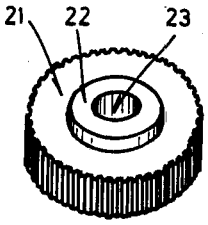
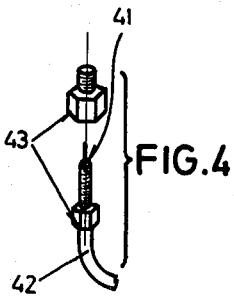

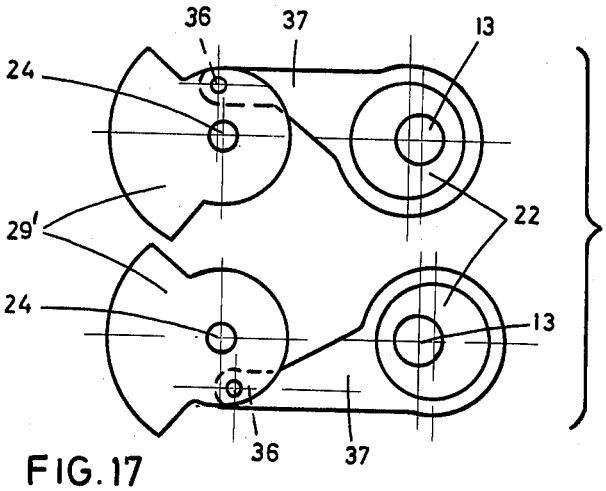
FIG. 16
FIG. 17
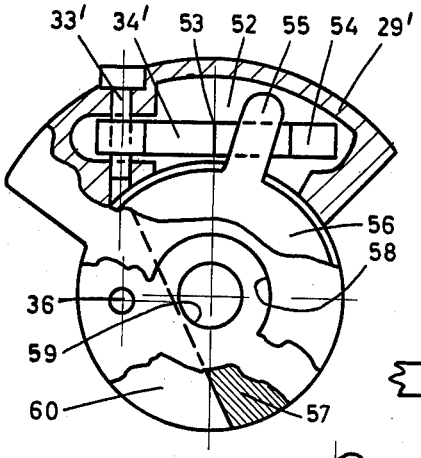
FIG. 18
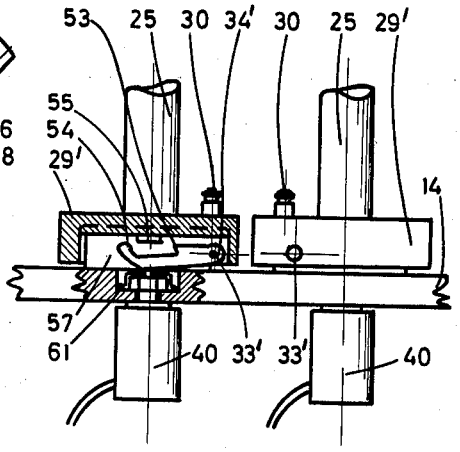
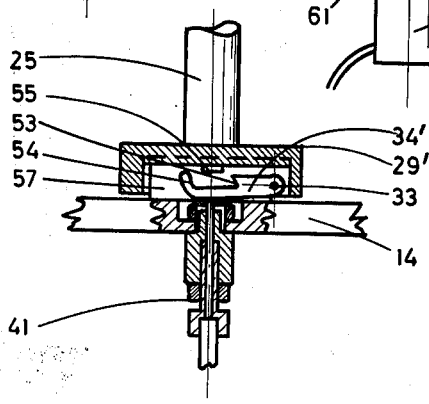
FIG. 19

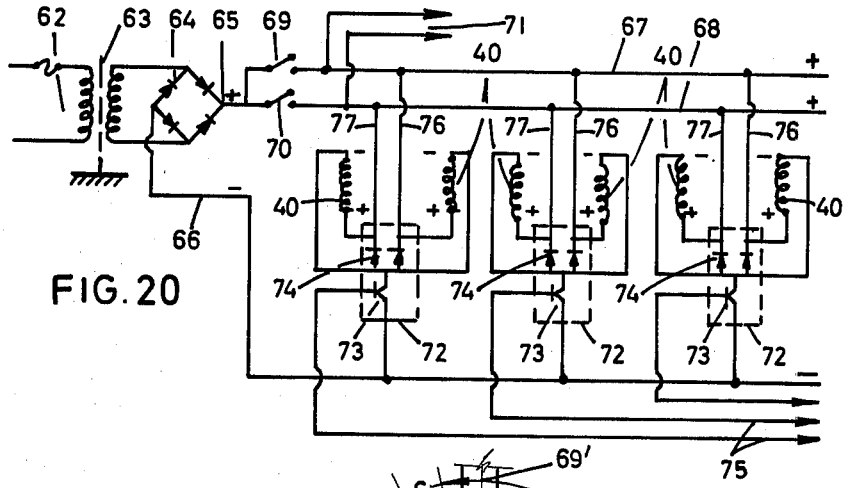
FIG. 20
FIG. 21
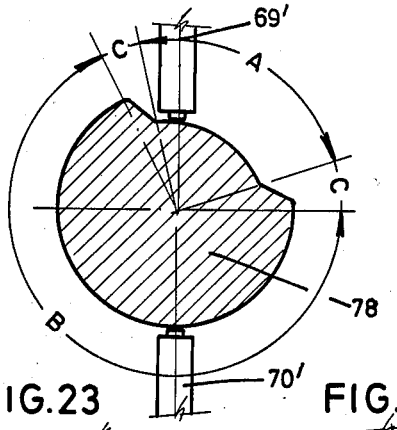
FIG. 22
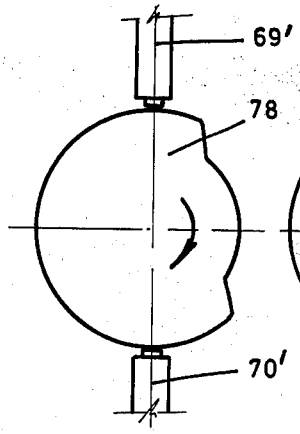
FIG. 23
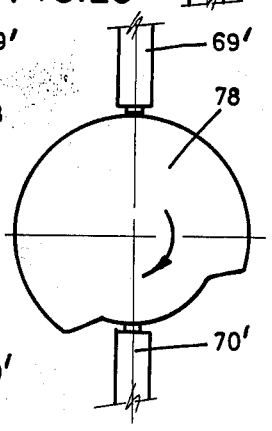
FIG. 24
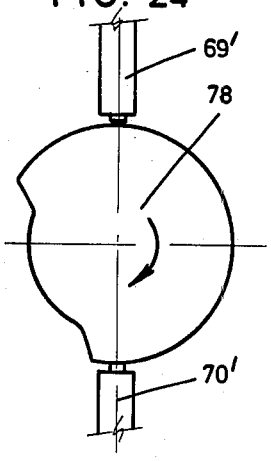

RACKING MECHANISM FOR BOBBIN MACHINE

CROSS-REFERENCE TO RELATED APPLICATIONS

This is a continuation-in-part of my pending application Ser. No. 869,033 filed Jan. 6, 1978; now U.S. Pat. No. 4,232,769 dated Nov. 11, 1980.

BACKGROUND OF THE INVENTION

The present invention relates to a mechanism for racking spindles in a bobbin machine and more particularly it relates to such a mechanism usable in a Jacquard-type loom or machine.

Basic features of the mechanism of this invention are disclosed in the aforementioned parent application Ser. No. 869,033.

SUMMARY

It is an object of this invention to provide a further improvement of the racking mechanism of the aforedescribed type in which the driving unit of the spindle rail can operate under optimum conditions without jamming or failure of parts.

Another object of this invention is to provide such a mechanism which improves the transmission of all movements during the detention and travel phases of the spindle rail in the lace-making operation.

In keeping with these objects, and others which will become apparent hereafter, one feature of the invention resides, in a driving mechanism for racking spindles in bobbin machines of the above-mentioned type, in the provision of an upper member for imparting travel to the bobbins and including, besides the revolving plate and the tapered spider pinion, three additional components. The first component is an intermediate disk, the revolving plate and the tapered spider pinion, an intermediate disk acting as a cam, provided with two diametrically opposed indentations and with a rim, a curved rim in this case, while the second member, carrying the tapered satellite pinions, is formed by a hollow body having outer cross-like stops and divided into two halves which retain the support (also provided with cross-like arms) for the inner pinions, and the third member is the driving cylindrical pinion which at one side is fitted with a tapered spider pinion, and is also provided with an eccentric cam at the other side. The cam is coupled to a connecting rod, the other end of which is combined with a coupling system driving a rotating member in the form of a sleeve or bushing, rotatable about an axle extending parallel to the stationary shaft for the three basic members. This rotating bushing carries a pallet or forked member with two arms arranged at different levels for controlling the movements of the entire mechanism during the stopping and racking phases of the movement of the bobbin. Such coupling and driving system has a ratchet device that can be operated, either electrically or mechanically; in the first case an electronic circuit is connected to a programmer-computer and in the second case the control is derived from the very Jacquard machine which cooperates in a conventional fashion with the bobbin machine.

The upper revolving plate is formed by two overlaying flat pieces, defining together an inner cavity housing a faceted head of a retaining screw which threads into a threaded hole of a stationary shaft traversing the whole cogged system of the mechanism. A rod extends from the head and projects upon the plates. The shaft moreover has a ring stop acting as a seat for a coaxial bearing combined with another bearing and other two needle bearings, assuring the operation of assembly without any flexural effects.

The diametrically opposed indentations in the disk, which is located in the first unit between the bobbin racking plate and the corresponding tapered spider pinion, have curved tracks coinciding with a matching curve provided at the end of the corresponding upper arm of the driving fork.

The intermediate or the second unit, defined by the hollow body for tapered satellite pinions, is formed by two pieces, the outer one being provided with the stops, normally four, for the corresponding arm of the adjacent pallet fork, and the inner support for the satellite pinions which are held between the two pieces of the intermediate unit.

The coupling and release system for the pallet fork is formed by a small strip solidly linked to the fork by the oscillating sleeve or bushing, this strip having an indentation in its lower plane to receive a locking ratchet hinged to a second strip attached to the first strip and cooperating with a connecting rod driven by the eccentric cam of the driving pinion of the mechanism. A stop and a return spring are fitted to the small strip attached to the pallet fork bushing. In the small strip combined with the connecting rod there is provided a notch coinciding with the ratchet and adapted to receive driving means such as for example, the moving core of an electrical coil or the end of a sliding wire running inside its protective sleeve.

Of the two mentioned adjoining strips, the upper one is attached to the bushing carrying the oscillating pallet fork causing the stopping and release of the driving strip of the spindle rail for driving the flat sinker, while the lower one is linked to the connecting rod combined at its turn with an eccentric cam of the cogged gear driving the entire assembly. The first strip is hollow to receive the jointed ratchet, designed with a certain profile having in its back a stop and this back ending in an inclined plane over which rests and oscillates a flat radial strip linked to another small strip, connected to the mentioned connecting rod, thus making both strips locked and transferring the movement from the driving gear to the pallet fork, when the flat radial strip comes caught in the ratchet stop. This ratchet stop, in the following stage (when the fork changes position), releases the flat radial strip and falls by its own weight. But this fall is further helped (in case when the ratchet becomes jammed) by the flat radial strip hitting against the end of the inclined ratchet plane.

The engaging phase of the flat radial strip with the jointed ratchet stop coincides with the racking movement of the spindle rail, when the ratchet is forced up by the action of the driving mechanism, having either the electrical coil with a moving core controlled by a corresponding electronic circuit acting from the attached programmer-computer, or a remote control wire operated by impulses coming from the Jacquard machine coupled to the bobbin machine. The ratchet release phase and its free fall coincides with the detention phase of the spindle rail.

The opening between the oscillating flat radial strip (continuously moved by the connecting rod driven by the eccentric cam of the gear driving the assembly) and the upper stop of the jointed ratchet, is effected by a spring leaning against each pair of adjoining upper small strips linked to the fork-holders, its tension being overcome when, owing to the triggering of the electrical or mechanical pulse forcing the ratchet up, the desired hook-up between the flat radial strip and the stop takes place and the pallet fork changes position. Through the differential-type gears rotating around the shaft parallel to the fork-holders, the pallet fork determines the detention and racking stages of the bobbin, conventionally placed on the standard strip which rotates 180° in order to twine the threads for knitting the lace.

The electrical coil driving the ratchet which engages and releases the pallet fork bushing, is protected against atmospheric aggression by means of an adequate elastic hood assuring the proper operation of the moving core. The coil is a part of an electronic circuit; this circuit includes an input reduction transformer, one rectifier and as many coil pairs as there are mechanism pairs in the machine, and one setup for each pair consisting of one transistor and a group of diodes, as well as at least two microswitches, operable by means of a lever which connects and disconnects the switches according to the preset working sequence of the machine. This electronic circuit is connected to the appropriate programmer-computer which emits signals to the bobbins at the same opening and closing intervals as the microswitches.

The mechanical system for driving the ratchet engaging and releasing the oscillating pallet fork involves as many sliding wires as there are mechanisms employed. These wires help in the movement of the ratchet at one of their ends, while the other ends are terminated in the Jacquard machine attached to the bobbin machine, where they are kept tensed by an adequate return spring and where they are lined up with the holes opened in the pattern card, which, in this case, slides on a prismatic drum moved at the correct time by a set of levers through the usual eccentric system from the gear transmission driven by the very bobbin machine itself.

The parallel position of the stationary shaft (where the three basic elements are free-mounted) relative to the moving bushing (carrying the oscillating fork and the lower small strip acting together with the coupling and releasing ratchet), permits the arms of the fork to act on the opposite indentations of the spindle racking component and on the component housing the four cross stops and having the satellite pinions, in order to achieve the detention and racking stages (or phases) of the bobbin. The pulse received by the fork depends on the pulse received by its bushing via its lower small strip from the other small strip. The other strip is constantly driven by the connecting rod which in turn is moved by the eccentric cam of the driving gear, acting on the ratchet located between both strips. This ratchet is electrically or mechanically activated, thus assuring the automatic return of the pallet fork to the position required for its upper arm to stop the member for racking the spindles, by means of the spring mounted on the small strip locked with such fork.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is an exploded perspective view of the main parts of the first embodiment of the mechanism of this invention;

FIGS. 2 and 3 show details of two of the parts in the embodiment shown in FIG. 1;

FIG. 4 shows the driving end of a driving unit for the ratchet in FIG. 1;

FIG. 16 shows schematically a plan view of a connecting rod system;

FIG. 17 is a detailed plan view, partly in section, of a member driven by the connecting rod in FIG. 16;

FIGS. 18 and 19 are details of the ratchet, respectively driven electrically and mechanically;

FIG. 20 shows a schematic diagram of electronic circuitry for automatically driving all ratchets of the type shown in FIG. 18;

FIGS. 21 through 24 are details of an eccentric cam designed for a switching section of the electronic circuitry of FIG. 20;

DESCRIPTION OF THE PREFERRED EMBODIMENTS

Figure 5:
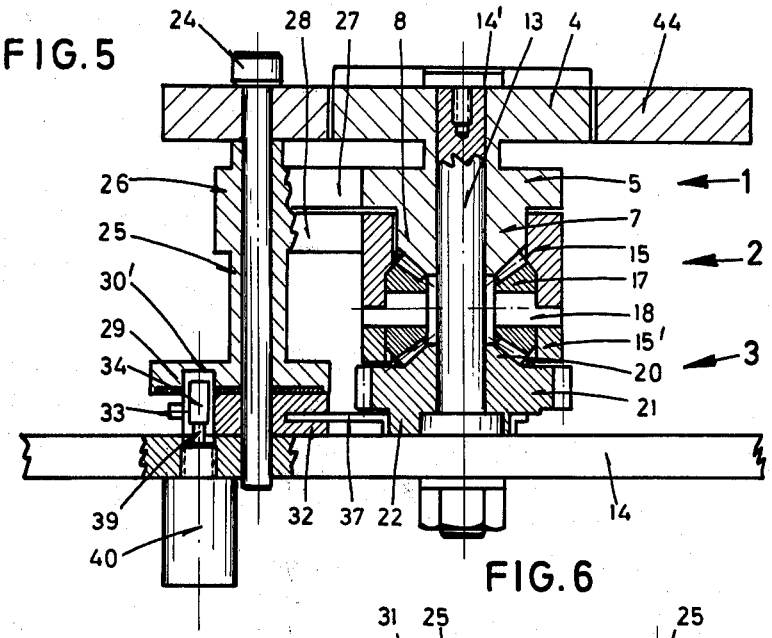
FIG. 5 shows a sectional side view of the mechanism of this invention mounted in a machine.

The mechanism of this invention is formed in its simpler version (FIGS. 1 through 7) by three main units or members 1, 2 and 3. The first member 1 includes a tubular body supporting a stepped upper plate 4, a disk-like cam 5 with diametrically opposite recesses or indentations 6 in its curved track, and an extension 7 terminated with a tapered spider gear pinion 8. The plate 4 cooperates with biconvex small plates 9 (FIGS. 25 and 26) carrying the spindles or bobbins 10, engaged in the standard arched recesses 11 in the plate 4. The entire member 1 is formed with an axially throughgoing bore 12 through which passes a stationary shaft 13 resting on the machine bracket 14 (FIG. 5). The member 1 is fastened to the stationary shaft by means of a terminal screw 14' engaging an internal thread at the end of the shaft.

The record unit or member 2 is formed by a hollow body or housing consisting of two equal parts 15 and 15' and having a cavity 15'' in which is received the cylindrical extension 7 of the first member 1. The hollow body 15 and 15' is of cruciform section, forming four recesses or stops between escape arms 16. Within the body 15–15' two tapered satellite gear pinions 17 freely rotate around shafts 19' retained between the two halves 15 and 15' and a central cross-shaped block or support 18. The block 18 has a central hole 19 (FIG. 2) through which passes the main shaft (13) and two mounting stems 19'' retained between the parts 15 and 15'.

The third unit or member 3 is formed by a tapered spider gear pinion 20 attached to a larger cylindrical spur gear pinion 21 carrying on its opposite face (FIG. 3) an eccentric cam 22. The whole assembly of member 3 has an axial bore 23 to allow passage of the main supporting shaft 13.

Another stationary shaft 24 is placed parallel to the main shaft 13 and supports for rotation or oscillatory movement a sleeve or bushing 25. This bushing is fitted with a pallet fork 26 having two arms 27 and 28 arranged at different levels corresponding, respectively, to the level of the disk 5 and to that of the cross-shaped area 16 of parts 15 and 15', as indicated by arrows in FIG. 1. An elastic pad 27' is built into the end of arm 27 to absorb the shock when the arm strikes in the corresponding indentation 6 of disk 5.

The bushing 25 is fitted at its lower end with a small strip 29 provided with a pin or stem 30 passing therethrough. The stem 30 acts as a stop and at the same time as a hitch post for a spiral spring 31. The lower face of this strip 29 has a notch or cavity 30' (FIG. 5).

A second small strip 32 is located just under the strip 29. The second small strip 32 has a passage 33 for receiving an angular ratchet 34 jointed by pin 33' to the latter. The second strip 32 has also a bore 35 for the shaft 24 and a joint link 36 for linking a connecting rod 36, the annular head 38 of which engages the eccentric cam 22 on the lower face of the pinion 21 (FIG. 5).

Figure 6:
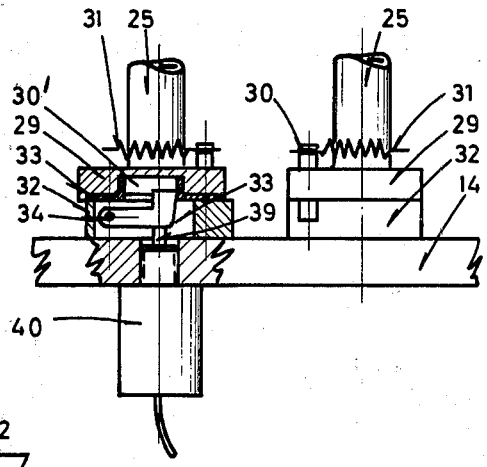
FIGS. 6 and 7 are sectional view of details of the ratchet applied to the mechanism of FIG. 5.
Figure 7:
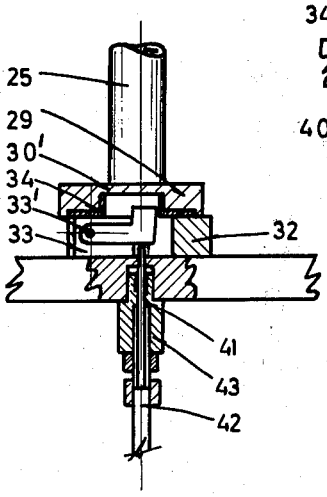

The driving mechanism for the ratchet 34 is arranged in alignment with the latter. This mechanism is formed by a dowell 39 linked either to the moving core of an electrical coil or solenoid 40 (FIGS. 1 and 6) or to the end 41 of a flexible driving or bowden wire sliding inside its sleeve 42 which is fastened to the bracket 14 (FIG. 7) with the aid of a threaded tensor assembly 43. The electrical driving system is shown in detail in FIG. 6 and the mechanical driving system for the ratchet is illustrated in FIG. 7. Both arrangements are interchangeable.

The stationary shaft 24 is also supported on the upper platform of the machine while all the remaining components are mounted between the machine and the lower bracket 14, as clearly seen in FIG. 5.

Figure 8:
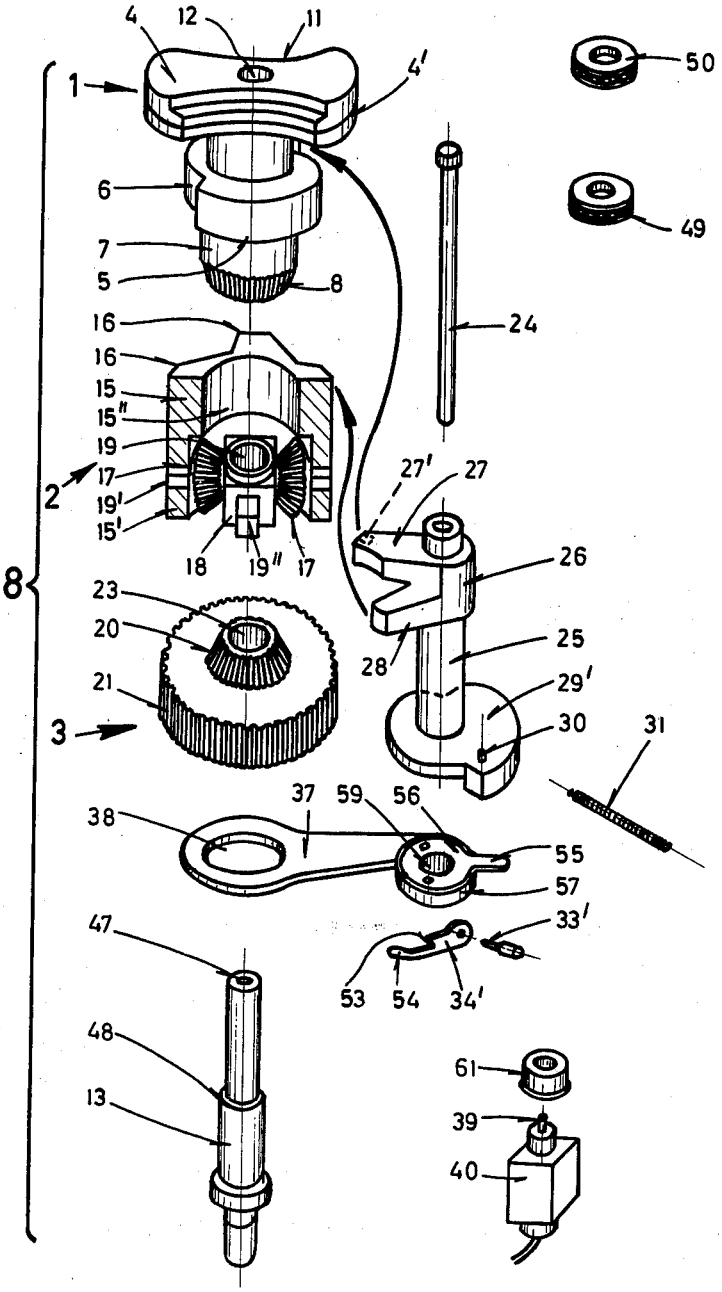
FIG. 8 is an exploded view of a second embodiment of the mechanism of this invention.
Figure 9:
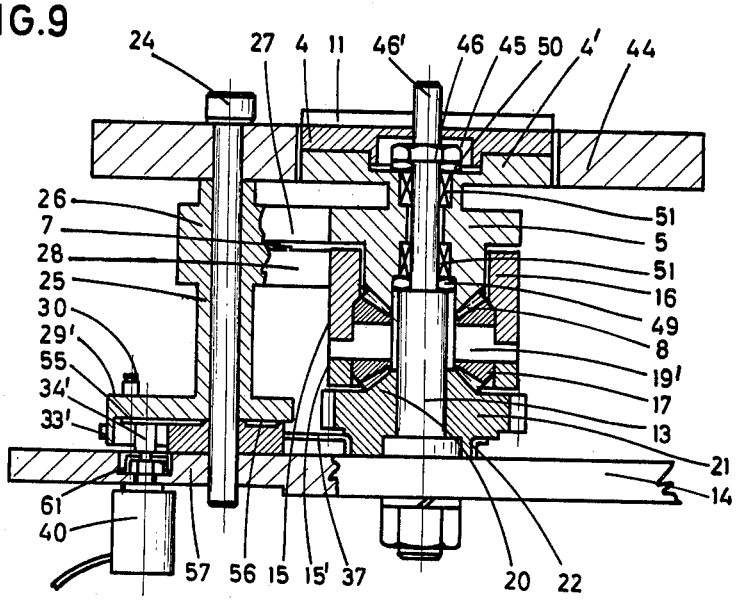
FIG. 9 is a sectional side view of the assembled mechanism of FIG. 8.

In the preferred embodiment shown in FIGS. 8 through 19, the following variations have been introduced:

The upper plate is now formed by two superposed parts 4 and 4', defining a cavity 45 to house a faceted head 46 of a retaining screw engaged in the threaded hole 47 at the end of the stationary shaft 13. The shaft 13 has a ring stop 48 acting as a seat for a coaxial bearing 49 paired with a similar bearing 50 and a completed with other two needle bearings 51 (FIGS. 8 and 9). A rod 46' extends from the faceted head 46, and projects above the plate 4.

The bushing 25 is firmly connected to the small flat plate 29' the shape of which is illustrated in FIG. 17. It can be seen that the plate 29' forms a box 52 which is open downwards, and the ratchet 34' is contained within the box 52. This ratchet 34' has on its upper surface a stop 53 and one end thereof is in the form of an inclined plane 54. This ratchet 34 is hinged on a pin 33', fastened to the box 52 in the plate 29'. A driving radial strip 55 which is a part of a disk 56 attached to the second plate 57 having also a disk-like shape, projects between the stop 53 and the inclined plane 54.

This small plate 29' is firmly connected to the bushing 25 (FIG. 8) while the assembly 56 and 57 can move freely, around the inner stationary shaft 24 passing through the bore 59. The small plate 57 has a side indentation 60 (FIG. 17), where a pin 36 is inserted, connecting the end of connecting rod 37. The head 38 of rod 37 engages the eccentric cam 22 of the driving gear 21.

The two small plates 29' and 57 are in close contact with each other, the first one carrying the outer stop 30 to retain spring 31. The way this spring is mounted can be seen in FIGS. 14 and 15.

In the described setup the moving core 39 of the electrical coil or solenoid 40 is protected against dust intrusion by means of an elastic hood 61 (FIGS. 8 and 18).

When the mechanism of FIGS. 1, 5, 6, 8, 9, 11, 12 and 18 is to be operated electronically it is connected to the circuit shown in FIG. 20. The circuit includes a power input 62 with a shielded and grounded transformer 63, followed by a rectifier 64. This circuit is protected by an adequate fuse in the primary line. The voltage available at the rectifier terminals is a low one, for example, 24 V.

The positive lead 65 at the output of the rectifier 64 branches out into two separate leads 67 and 68 fitted with inserted microswitches 69 ("even function") and 70 ("uneven function"). These branch leads 67 and 68 are connected to a conventional programmer-computer (not shown) through leads 71. Control devices 72, each with one transistor 73, and a pair of diodes 74 connect corresponding pairs of coils 40 between the positive leads 67 and 68 and the negative lead 66. Leads 75 connect the base of transistors 73 to the programmer-computer. The diodes 74 are connected across the assigned coils 40 and through leads 76 and 77 are connected to the leads 67 and 68, respectively.

The microswitches 69 and 70 are activated (opened and closed) by a revolving cam 78 (FIGS. 21 through 24) of adequate design with a low track A and a high track B, linked by transition ramps c. The levers 69' and 70' with contact rollers follow the edge of the cam 78 and activate respective microswitches 69 and 70.

Two cams can be used instead of one cam 78, one for each microswitch 69 and 70.

In the positions shown in FIGS. 21 through 24, the operating sequence of the levers 69' and 70' is as follows:

| | | |
|---|---|---|
| FIG. 21.-Microswitch | 69 closed; | microswitch 70 open. |
| FIG. 22.-Microswitch | 69 open; | microswitch 70 open. |
| FIG. 23.-Microswitch | 69 open; | microswitch 70 closed. |
| FIG. 24.-Microswitch | 69 open; | microswitch 70 open. |

Figure 25:
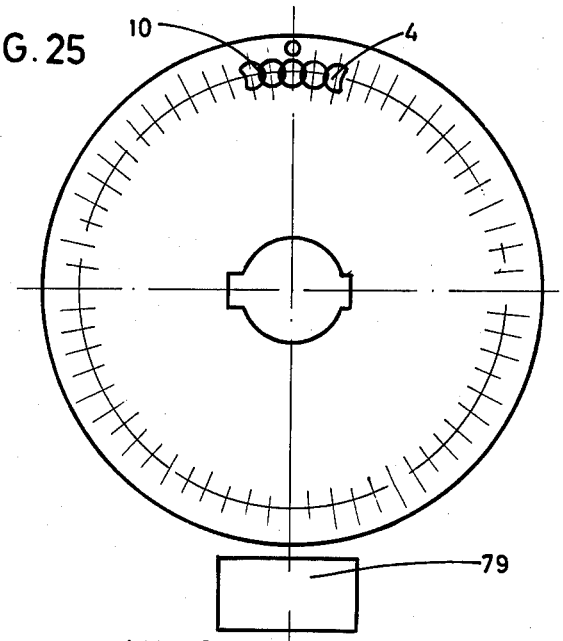
FIGS. 25 and 26 are plan views and schematic diagrams of the bobbin machine fitted, in the first case, with an electronic unit, and in the second case, with a mechanical unit for driving the ratchets.
Figure 26:
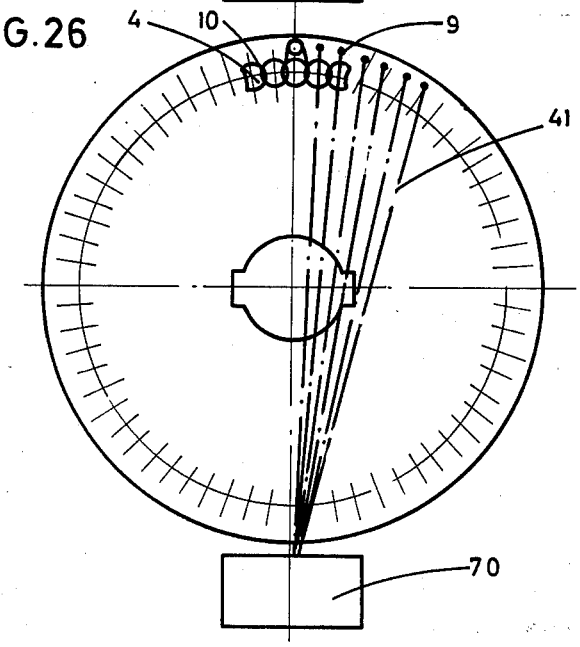
Figure 27:
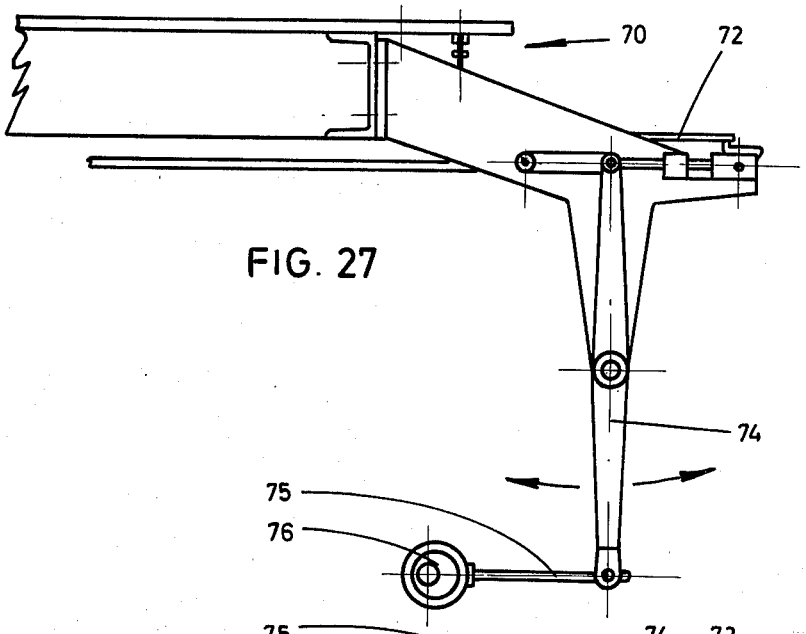
FIGS. 27 and 28 are, respectively, plan and elevation views of a purely mechanical device which can substitute the electronic circuitry of FIG. 20.

FIG. 25 shows a plan view of the bobbin machine when fitted, with the electronic unit, and in FIG. 26, with the substituted mechanical device. In the first setup there is no direct connection with the Jacquard machine 70 while in the second setup, the activation of the pulse transmitting wires is originated in the Jacquard machine, as shown in greater detail in FIGS. 27 through 30.

For the mechanical operation, the Jacquard machine is fitted with a prismatic drum 71 rotating rythmically by the trigger action of lever 72, simultaneously with the action of lugs 73, while outer levers exert upon the drum in a to-and-fro motion, these outer levers being moved by connecting rods 75, moved at their turn by eccentric cams 76 connected to the shaft 77 rotating by the action of a conical gear 78 power driven via a driving shaft 79 from the bobbin machine.

The driving bowden wires 41 are surrounded by coil springs 80 which draw back the probe ends 81 of these wires. The ends 81 may or may not coincide with the holes 82 punched (FIG. 30) in the card which moves as the drum 71 rotates, thus determining the pattern of the lace or fabric. It is evident that in this fashion some wires will be mechanically driven and some others will not, in accordance with the order of the holes punched in the pattern card.

The operation of the entire assembly the mechanism of this invention, in broad terms, is as follows:

The driving spur gear or cylindric pinion 21 engages another pinion (not shown), driven by the main motor of the machine. The rotation of this pinion 21 causes, through its eccentric cam 22, the connecting rod 37 to oscillate to-and-fro and, as a consequence, the to-and-fro movement is transmitted to the small plate 32 (FIGS. 1 through 7) or to the small plate 57 (FIGS. 8 through 19) the latter oscillating around the shaft 24. These plates 32 or 57 do not become locked with the adjacent plates 29 or 29' until the ratchet 34 or 34' which can be driven either electrically or mechanically, is activated. Referring to FIGS. 6 and 7, there is illustrated how the transfer of the driving pulse to the bushing 25 and, therefore, to the pallet fork 26, depends on the position of the ratchet 34. When the ratchet 34 is out of its housing 30' owing to the withdrawn position of its driving element 39 connected to the moving core of the coil 40 or to the end of the wire 41, the small plate 32 moves without entraining the upper small plate 29. If the ratchet 34 is in its activated mode either by virtue of the activated bobbin 40 or by the wire 41, the plate 32 engages the superposed plate 29.

In the improved setup shown in FIGS. 8 through 19, small plate 57 becomes firmly locked with small plate 29' when, by means of the solenoid 40 or of the bowden wire 41 the shaped ratchet 34' is raised and the flat radial strip 55 linked with the oscillating member 57 hits the stop 53, thus engaging and pulling the plate 29'. The flat radial strip 55 by hitting the end 54 insures that the ratchet 34' falls even in the case when it is jammed.

The electrical operation of the mechanism, when equipped with solenoids 40 for coupling and decoupling the plates 32 and 29, or 57 and 29' in order to move the pallet fork 26 will be described with reference to FIGS. 20 through 24. As seen from the schematic diagram of FIG. 20, the control device 72 which is arranged between each pair of coils 40 is activated via a lead 75 by a non-illustrated programmer-computer. The number of leads 75 is equal to half the amount of spindles in the machine.

The microswitches 69 ("even function") and 70 ("uneven function") are activated by a cam 78 revolving at the same speed as the machine, the connecting and disconnecting time intervals of the microswitches varying with the speed of the machine.

Each time the circuit is closed by means of a microswitch 69 or 70, operated according to the sequence shown in FIGS. 21 through 24, the computer is fed with a signal through leads 71 and answers instantly by supplying through leads 75 a series of signals to the devices 72. If, for instance, microswitch 69 is closed, a plus voltage is applied to all even coils 40. Some of the even coils 40, besides, are connected to the negative voltage via control devices 72 activated by a signal given by the computer in accordance with the working program of the machine. As a result, the latter coils are energized to effect the engagement between plates 32 and 29 (FIGS. 1 through 7) or plates 57 and 29' (FIGS. 8 through 19), for the time interval during which the microswitch 69 is closed (FIG. 21).

The same operation applies to "uneven" microswitch 70 as shown in FIG. 23.

In this way, the alternating connection of even and uneven coils 40 is achieved, as directed by the signals sent by the programmer-computer.

When the speed of the machine decreases, the cam 78 activating the microswitches 69 and 70 rotates slowly and their connecting time (FIGS. 21 and 23) as well as the energization of the coils 40 is longer, thus allowing enough time for the ratchet system 34 or 34' to couple plate 32 with the plate 29 or plate 57 with the plate 29' thus causing the pallet fork 26 to oscillate. When the machine is running fast, coils 40 are energized for a short time only since the cam 78 rotates at a great speed which prevents ratchet 34 or 34' from hooking up the plate 32 to the plate 29 or plate 57 to plate 29'. As a result, the fork 26 remains inactive.

A perfect synchronization is insured even if the machine is rotated manually (by means of a crank) for example, since the computer controls the pattern automatically.

The computer emits a series of "even" control signals when the microswitch 69 (FIG. 21) becomes closed, which condition is maintained until the microswitch opens (FIGS. 22, 23 and 24). Next, the actuation of the microswitch 70 results in a series of "uneven" control signals (FIG. 23), which signals are maintained until switch 70 opens (FIGS. 22 and 24) and so on.

If for some reason one of the microswitches 69 or 70 should become closed two times in a row, the computer is set to avoid the transmission of two repeated series of "even" or "uneven" control signals, that is, it only emits alternating signals. In other words, if the computer receives a signal from microswitch 69, it will respond with a series of signals to the "even" coils 40, but then, if by a failure of the "uneven" microswitch 70, it receives a second signal from the same microswitch 69 the computer is programmed not to respond with a series of signals to the coils 40 so preventing the pattern being weaved from being jumbled.

The computer, besides the described basic control function, performs other tasks, as counting the hours of operation and the long and analogue torques of the machine proper. The same computer also has a safety function should the machine become jammed, in which case, due to the temporary inactivity of the microswitches 69 and 70, it will receive their signal at a frequency lower than the one that has been preset and then the computer is programmed to shut down the machine motor. The value of the minimum frequency at which the computer will shut down the motor is adjustable at will through the computer program.

Figure 28:
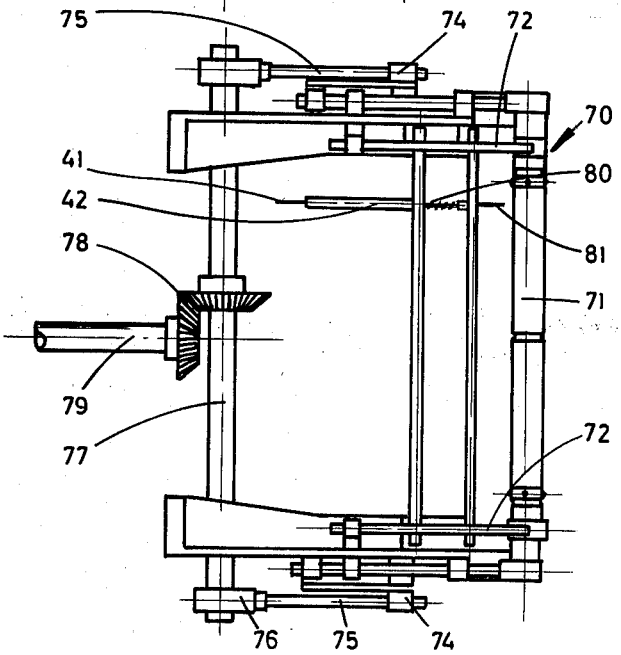
Figure 29:
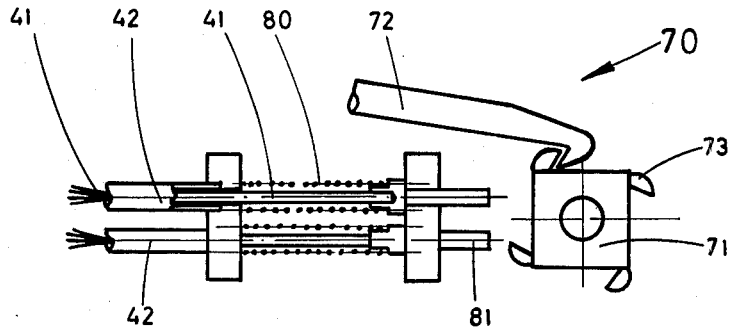
FIGS. 29 and 30 are enlarged details of a part of the device of FIGS. 27 and 28.
Figure 30:
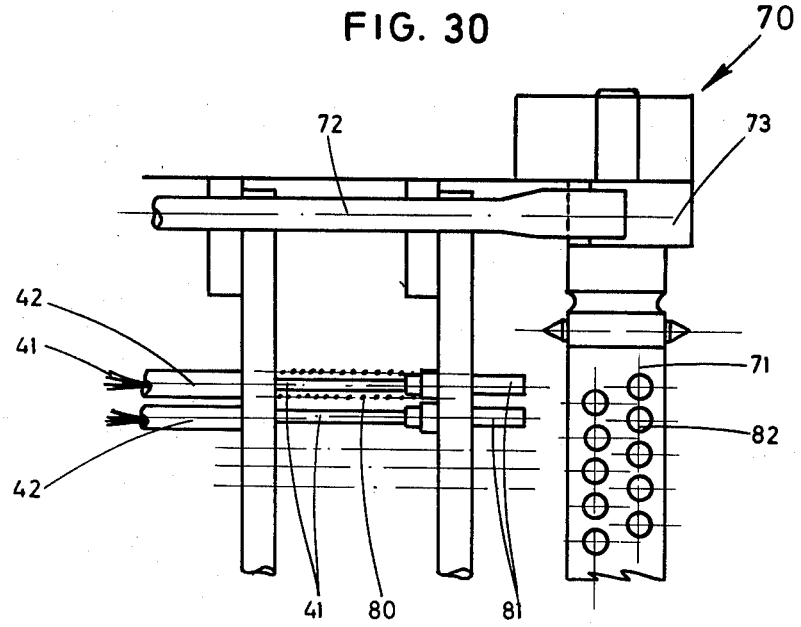

The results electronically obtained with the circuit and other elements described can also be obtained with the mechanical device the main parts of which are shown in FIGS. 4, 7, 13, 19, 26 and 30. In this case, the actuation of the hook-up ratchet 34 or 34' in order to engage plate 32 with plate 29 or plate 57 with plate 29', thus making fork 26 to rotate to-and-fro, is effected by means of a remote control wire 41 mounted with its driving end in the same position as the moving core of coil 40, as can be seen in FIGS. 7 and 19. These wires 41 run from each bobbin driving mechanism of the Jacquard machine 70 (FIG. 26) and are powered by the latter in the fashion shown in FIGS. 27 through 30. The terminals 81 of the wires 41 receive rhythmic advance pulses as they match the holes 82 the pattern card moving on the prismatic body 71 of the Jacquard machine, receiving power by means of a conventional transmission 79, 78, 76, 74 and 72 (FIG. 28). The return of terminals 81 is insured by return springs 80.

The results are the same, both with the electric or the mechanical driving devices.

The operation of the remaining components of the mechanism of this invention is as follows:

The stage in which spindles are not racked.

In this phase (FIG. 11), the driving unit (electrical or mechanical) is not activated and thus the ratchet 34 or 34' does not hook up the small plates 32 and 29 or 57 and 29' as they rotate. The pallet fork 26 is undirectionally biased by spring 31 and additionally, (FIGS. 1 through 7), by the pressure exerted by the small lower plate 32 against the lower extension of the stem or pin 30, projecting from the upper plate 29, and is brought in such a position in which the arm 27 is pressed against the disk rim 5 and is forced to enter one of the two indentations 6 in the disc 5. This indentation, acting as a stop, keeps immobilized the entire upper section 1. As a consequence, small plates 9 (FIGS. 25 and 26), carrying the spindles or bobbins 10, remain in the same unaltered position.

The continuous rotation of the driving gear 21 is transferred to its leveled spider pinion 20 which, engaging the satelite pinions 17 which are locked by the other spider pinion 8 in the unit 1 and by differential effect, the entire intermediate section 2 is driven to rotate in the same direction as the driving gear 21. The rotation of the unit 2 is unhampered by the lower arm 28 of the fork 26, since the latter, due to the position of the bushing 25 enforced by the spring 31, is kept away from the stop housing 16, and only a smooth peripheral sliding takes place.

The continuously rotating driving gear 21 also continuously rotates and the latter, through the connecting rod 37 moves the small plate 32 or 57. Owing to the fact that, in this state, ratchet 34 or 34' is not activated by the coil 40 or by the wire 41, the plates 32 or 57 have not yet engaged the small plates 29 or 29' in a direction contrary to that of the spring 31.

The stage in which spindles are racked.

In this phase (FIG. 13), a driving pulse has been sent to ratchet 34 or 34' either from the electronic circuit (FIG. 20) or from the Jacquard machine 70 (FIGS. 26 through 30), raising the ratchet 34 or 34' (FIGS. 6, 7, 18 and 19) and causing the small plate 32 to engage with small plate 29 or the small plate 57 with the small plate 29' thus overcoming the pressure from spring 31. The bushing 25 with the fork 26 rotate against the spring 31 and the arm 27 disengages the indentation 6 and remains in free contact only with the rim of the disk 5. At the same time, the other arm 28 of the pallet fork 26 has entered one of the two recesses in the cross 16, thus stopping the entire unit 2. The transmission of driving force from the spider pinion 20 to the satellite pinions 17 is maintained, but as the latter can not orbit owing to the arrested unit 2, they rotate about the axes 19' and by means of the spider pinion 8 and, by the differential effect, this rotation is transmitted to the plate 4 onto the double plate 4,4' in the opposite direction as that of the main gear 21. The result is a change of position, or a racking, of the small plates 9 (FIGS. 25 and 26) which move to a diametrically contrary position, as desired for crossing the threads in the lace-making operation.

Figure 10:
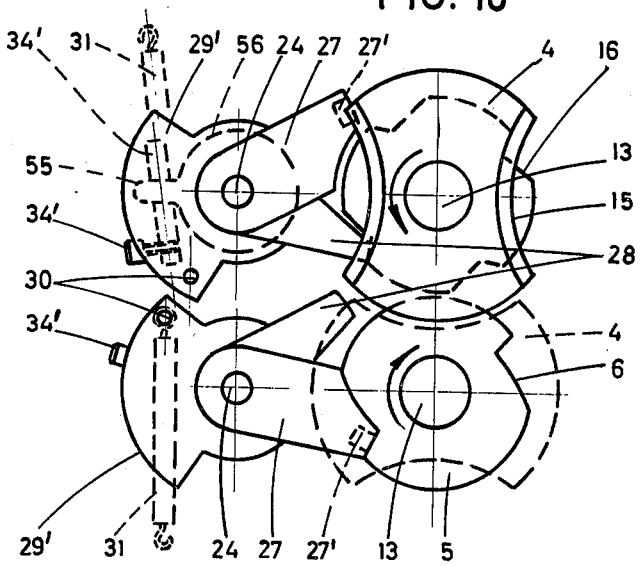
FIG. 10 is a plan view of two mechanisms of FIG. 9 installed side by side in the same machine.
Figure 11:
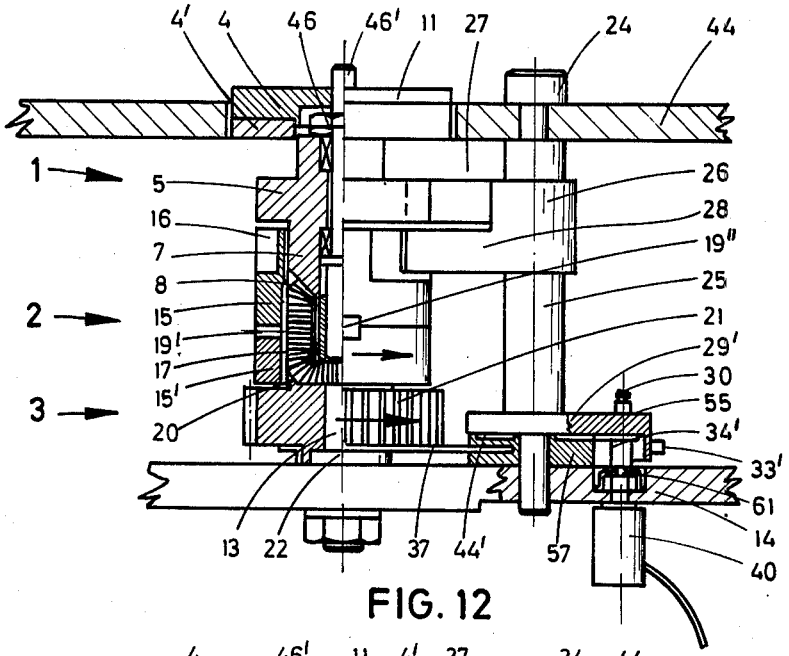
FIG. 11 is an elevational view partly in section, of the mechanism of FIG. 9.
Figure 12:
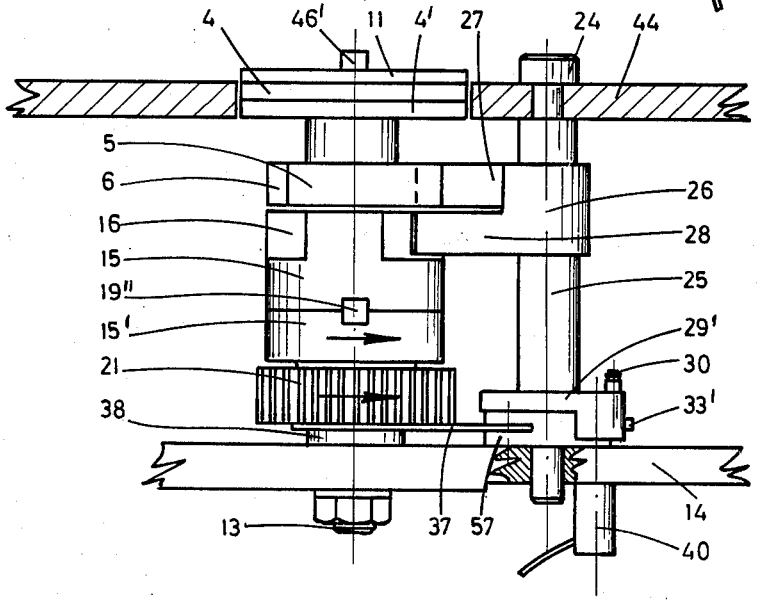
FIG. 12 is an elevational view of the mechanism of FIG. 11 showing the movements transferred to such mechanism.
Figure 13:
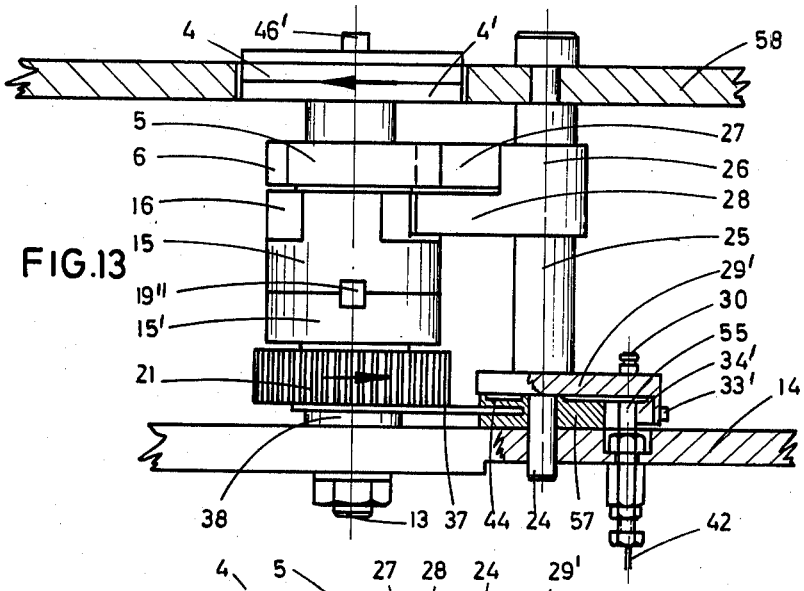
FIG. 13 is a view similar to FIG. 12, but showing a mechanically driven ratchet.
Figure 14:
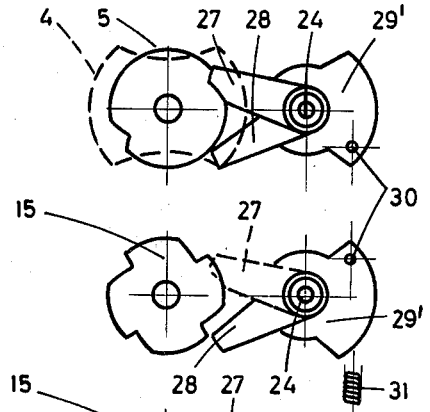
FIGS. 14 and 15 show in a plan view the movements of two mechanisms of FIG. 13 mounted side by side.
Figure 15:
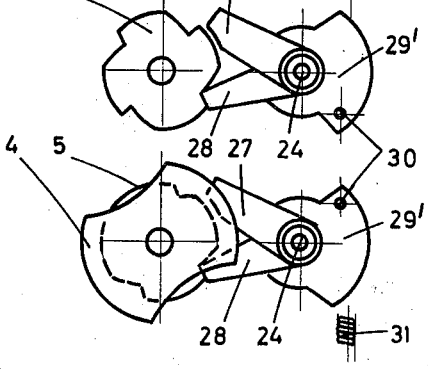

When the electric or mechanical driving pulse occurs, the return to the previous position (locking of single plates 4 or double plates 4–4') is effected mainly by the spring 31. In the version shown in FIGS. 1 through 7 spring 31 is assisted by the small plate 32 striking against the projection of the stem 30 which is rigid with the upper small plate 29. FIGS. 10 and 16 illustrate the operation of two adjacent mechanisms, of which, the one occupying the lower position in the Figures is shown in the spindle immobilizing phase in which spring 31 urges arm 27 against the indentation 6 while the upper mechanism is in the spindle racking phase in which the arm 28 engages recesses 16 upon overcoming the tension of the spring 31. The changes of position of the fork 26 are shown in FIGS. 10, 14 and 15, depending on the action of the lower cam 22, connecting rod assembly 37 and the coupling assembly 32 and 29, 57 and 29'. FIG. 14 shows the detention phase and FIG. 15, the spindle racking phase. FIG. 10 shows the position of the forks in two mechanisms arranged side by side, as well as the operation of the ratchet 34' (in dotted lines) and of the springs 31.

The driving gear 21 rotates at twice the speed of the unit 2 so, as the rotating single plate 4 or double plate 4–4' and the driving gear 21 revolve about 180°, the satellite pinion carrier assembly or unit 2 revolves only 90° and for this reason the unit 2 has the stop housing 16 in a cross-like shape.

The electrical mode of operation of the mechanism of this invention can be easily understood from FIGS. 20 through 24; in connection with the preceding description of the signal output from the programmer-computer to coils 40 according to the sequence originated from the cam 79 activating microswitches 69 and 70. In this electrical version, the bobbin machine presents the setup shown in FIG. 25.

The mechanical mode of operation, which can be readily substituted for the electrical, is exemplified in FIGS. 26 through 30, illustrating the driving bowden wire 41, acting upon the ratchet 34 and/or 34'. These wires 41 run to-and-fro inside their sleeves at the rhythm imparted to them by their ends 81 in response to holes 82 punched in the pattern card revolving in conventional manner by the effect of a standard machine transmission (FIG. 26).

It will be understood that each of the elements described above, or two or more together, may also find a useful application in other types of constructions differing from the types described above.

While the invention has been illustrated and described in specific examples of a bobbin racking mechanism for a jacquard machine, it is not intended to be limited to the details shown, since various modifications and structural changes may be made without departing in any way from the spirit of the present invention.

What is claimed as new and desired to be protected by Letters Patent is set forth in the appended claims.

1. A bobbin-racking mechanism for a jacquard machine, said mechanism comprising:

a support;

a drive gear rotatable on said support above a drive axis and supporting an input gear and an eccentric cam;

a transmission member rotatable on said support independent of said drive gear about said drive axis;

an output member connectable to a bobbin and rotatable on said support independent of said drive gear and transmission member about said drive axis;

an output gear fixed to said output member and spaced from said drive gear;

a transmission gear rotatable on said transmission member about a transmission axis transverse to said drive axis and simultaneously meshing with said input gear and said output gear, whereby on rotation of said transmission member said transmission gear orbits about said drive axis;

operator means selectively engageable with said members; and coupling means arranged between said cam and said operator means for displacing the latter between a stopping position preventing rotation of said output member and permitting rotation of said transmission member and a racking position permitting rotation of said output member and preventing rotation of said transmission member.

2. The mechanism as defined in claim 1, wherein said output member further includes a cam disk having two diametrically opposed recesses; said transmission member having an outer housing of a cross-like configuration defining four stop arms; said operator means including a sleeve supported for rotation about an axle extending parallel to said drive axis, said sleeve carrying at one end thereof a pallet fork having two arms forming together an angle and each being arranged at a different level corresponding to that of said recesses in said cam disk and of said cross-like stop arms in said outer housing.

3. The mechanism as defined in claim 2, wherein said coupling means includes a locking device connected to said sleeve, a coupling rod engaging at one end said eccentric cam on said drive gear and being linked at the other end to said locking device to impart an oscillatory movement thereto; and a remote control device for controlling the coupling between said locking device and said sleeve.

4. The mechanism as defined in claim 3, wherein said support includes a stationary stepped shaft coaxial with said drive axis and bearing means for rotatably supporting said members, said output member including an upper plate assembled of two superposed pieces defining a cavity therebetween, and a retaining screw engaging the end of said stationary shaft and having its head disposed in said cavity.

5. The mechanism as defined in claim 3, wherein said cam disc is arranged between said upper plate and said output gear, said opposite recesses in said cam disc defining curved tracks matching the end of the upper arm of said pallet fork.

6. The mechanism as defined in claim 3, wherein said cross-like outer housing of said transmission member is tubular and encloses a support for the transmission gears and said stop arms cooperating with the lower arm of said pallet fork.

7. The device as defined in claim 4, wherein said locking device includes an upper plate rigidly connected to the lower end of said sleeve, an underlying lower plate supported for rotation about said axle and being linked to said connecting rod; and an arresting ratchet hinged to one of said plates and being operable to engage the other plate when actuated by said control device; and a biasing spring for urging said upper plate and thus the sleeve with said pallet fork into said stopping position in which said upper arm of said pallet fork engages one of said recesses in said second disk.

8. The mechanism as defined in claim 7, wherein said lower plate includes a cutout for admitting a driving element for said ratchet.

9. The mechanism as defined in claim 8, wherein said ratchet is hinged in said upper plate and defines a recessed stop surface portion and an inclined end portion; said lower plate having a radial projection oscillating over the ratchet to engage the ratchet stop surface and thus to transfer the movement from the drive gear to the sleeve and to the pallet fork when the ratchet is activated by said control device.

10. The mechanism as defined in claim 9, wherein said control device includes a solenoid mounted on said support in the range of movement of said ratchet.

11. The mechanism as defined in claim 9, wherein said control device includes a bowden wire mounted on said support in the range of movement of said ratchet.

12. The mechanism as defined in claim 9, wherein the engagement of the ratchet with the oscillating radial projection takes place in the stage in which the spindle rail is racked whereby in the stage when the spindle rail is detained the ratchet is released and disengages the radial projection by is own weight.

13. The mechanism as defined in claim 12, wherein said biasing spring maintains the clearance between the oscillating radial projection of said lower plate and the stop surface of the ratchet whereby the force of said spring is overcome at the point when the ratchet is lifted by the control means and the radial projection engages the stop.

14. The mechanism as defined in claim 10, wherein said control means includes an electronic circuit comprising a plurality of pairs of said solenoids, a source of DC voltage having output poles; two cam operated switches connected between one output pole of said source and two parallel conduits; a plurality of remotely controlled electronic switches connected between the other pole of said source and the first terminals of said solenoids in each pair; the other terminals of said solenoids in each pair being connected respectively to said parallel conduits; and a programmable computer having input conduits connected to said two parallel conduits and output conduits connected for controlling said electronic switches.

15. The mechanism as defined in claim 11, further comprising a driving mechanism including a drum for supporting a pattern card with a plurality of punched holes, said drum being driven by said bobbin machine, the free end of said bowden wire being connected to the Jacquard machine, and means for biasing the wire into alignment with the punched holes in said pattern card.

* * * * *